US007140227B2

(12) United States Patent
Bouman et al.

(10) Patent No.: US 7,140,227 B2
(45) Date of Patent: Nov. 28, 2006

(54) PNEUMATICALLY-OPERATED REPETITION RIVETING TOOL

(75) Inventors: Wim Bouman, Toronto (CA); Aiden Robert Dear, Herts (GB); Angraj Kumarj Seewraj, Herts (GB)

(73) Assignee: Textron Fastening Systems Limited (GB)

( * ) Notice: Subject to any disclaimer, the term of this patent is extended or adjusted under 35 U.S.C. 154(b) by 331 days.

(21) Appl. No.: 10/925,498

(22) Filed: Aug. 24, 2004

(65) Prior Publication Data

US 2006/0042345 A1 Mar. 2, 2006

(51) Int. Cl.
*B23P 11/00* (2006.01)
*B21J 15/28* (2006.01)
*B21D 9/05* (2006.01)

(52) U.S. Cl. ..... 72/391.6; 72/453.19; 29/812.5; 29/243.53

(58) Field of Classification Search ..... 72/391.4, 72/391.6, 453.19, 453.17, 453.18, 466.4, 72/391.2, 391.8; 29/812.5, 243.53, 243.523
See application file for complete search history.

(56) References Cited

U.S. PATENT DOCUMENTS 4,027,520 A * 6/1977 Klein ..... 29/509
4,310,056 A * 1/1982 Olsson ..... 173/169
4,454,746 A * 6/1984 Schwab ..... 29/243.525
4,612,793 A * 9/1986 Klein ..... 72/391.8
4,648,258 A * 3/1987 Frearson ..... 29/243.525
5,390,524 A * 2/1995 Higgs ..... 72/391.6
6,637,099 B1 * 10/2003 Seewraj ..... 29/812.5

* cited by examiner

*Primary Examiner*—Dmitry Suhol
(74) *Attorney, Agent, or Firm*—Trexler, Bushnell, Giangiorgi, Blackstone & Marr, Ltd

(57) ABSTRACT

A hydro-pneumatically operated repetition riveting tool, which tool includes a gripping means for releasably gripping an elongated mandrel at a position remote from the mandrel head, which gripping means comprises a housing with an internal taper, and a plurality of mandrel-gripping jaws which are urged into contact with the mandrel by means of the internal taper; hydraulic retraction means for retracting the mandrel, thereby to pull the head of the mandrel through a rivet on the mandrel and adjacent the head, thereby to place the rivet; return means for returning the mandrel forwardly again after placing a rivet; and rivet feeding means for feeding rivets forwardly towards the mandrel head; in which the return means is pneumatically powered; and in which the housing of the gripping means comprises a first part and a second part, spring means for urging the first and second parts relatively apart from each other, and limiting means for limiting the movement apart of the first and second parts under the urging of the spring means.

9 Claims, 5 Drawing Sheets

PNEUMATICALLY-OPERATED REPETITION RIVETING TOOL

The invention relates to a pneumatically-operated repetition riveting tool. One example of such a tool is that commercially available under the name AVDEL (Registered Trade Mark) Type 753 tool.

Such tools are used to instal or place blind tubular rivets, a plurality of which are pre-loaded on an elongated mandrel, the head of which is pulled through each rivet in turn to place it. The tool includes means for retracting the mandrel, means for returning it forwards again, and means for feeding unplaced rivets forwards along the mandrel towards its head. In such tools the retracting means is hydraulic, powered by a pneumatic/hydraulic intensifier. The means for returning the mandrel forwards again is spring-powered. The tool also includes means for releasably gripping the tail end of the mandrel remote from its head, the mandrel being released when appropriate to be removed from the tool and replaced by a new mandrel pre-loaded with further rivets. Such releasable gripping means comprises a plurality of jaws which are radially urged into contact with the mandrel by means of an internally tapered housing.

The construction and operation of such a tool is well known and understood by those skilled in the art of pneumatically operated repetition riveting tools.

It has recently been found that such existing tools are of a size which is inconvenient for some industrial applications, and there is a demand for tools of substantially reduced dimensions, at least in the direction along the mandrel, which in use is perpendicular to the workpiece in which rivets are being placed.

The invention provides, in one of its aspects, a pneumatically-operated repetition riveting tool as set out in claim 1 below. Further preferred features of the invention are as set out in the appended sub-claims.

Figure 1:
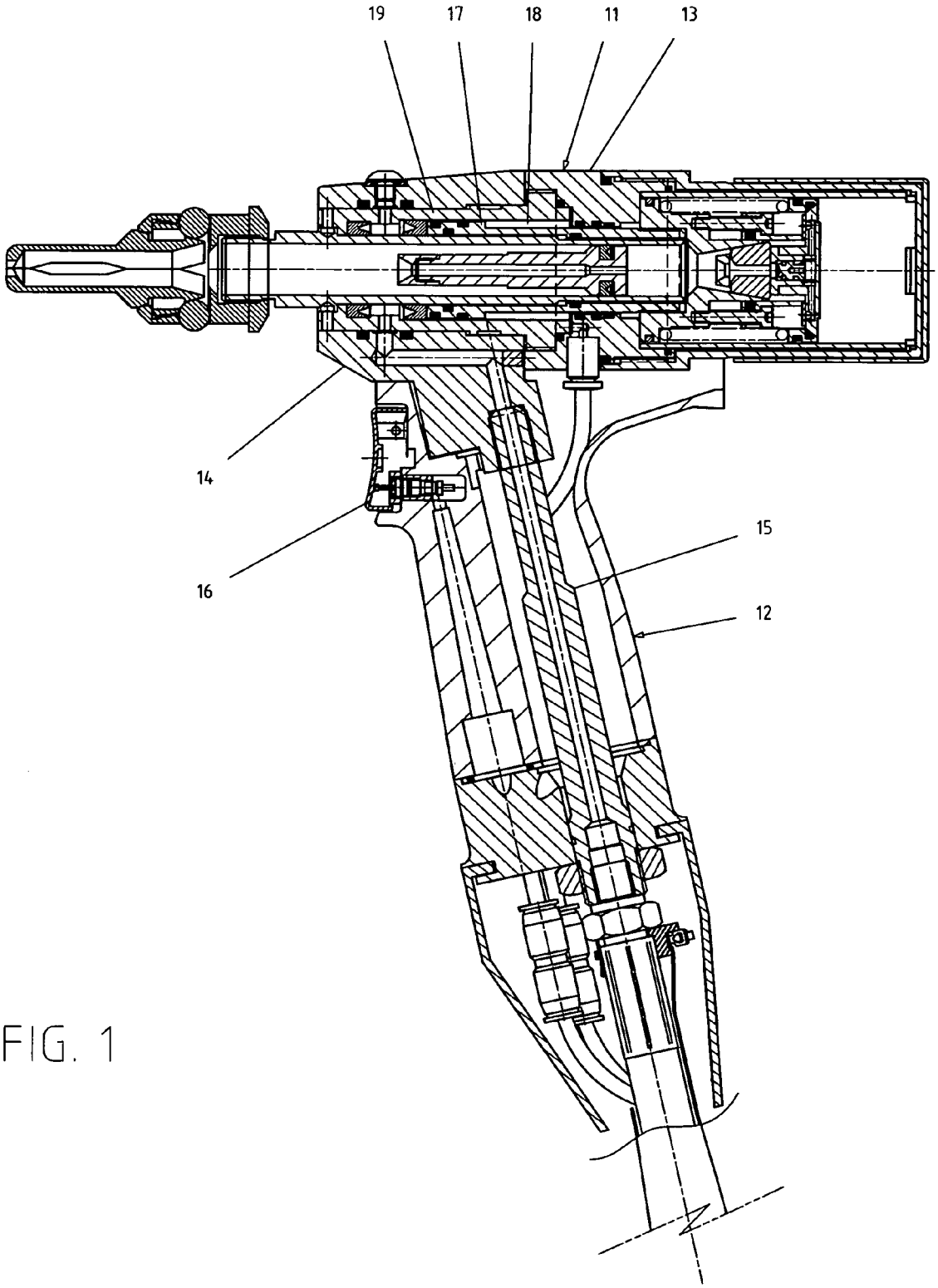
Figure 3:
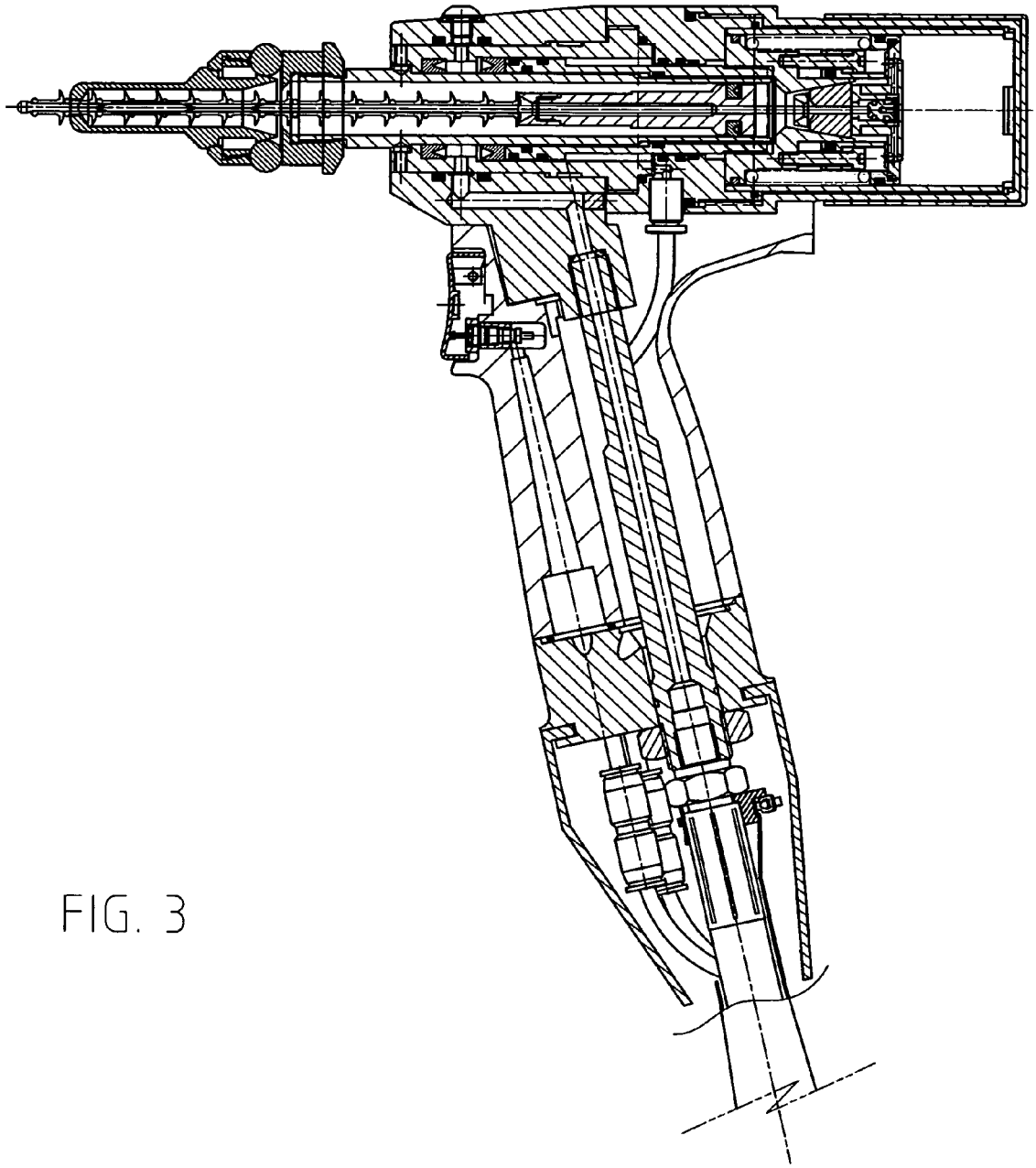
Figure 4:
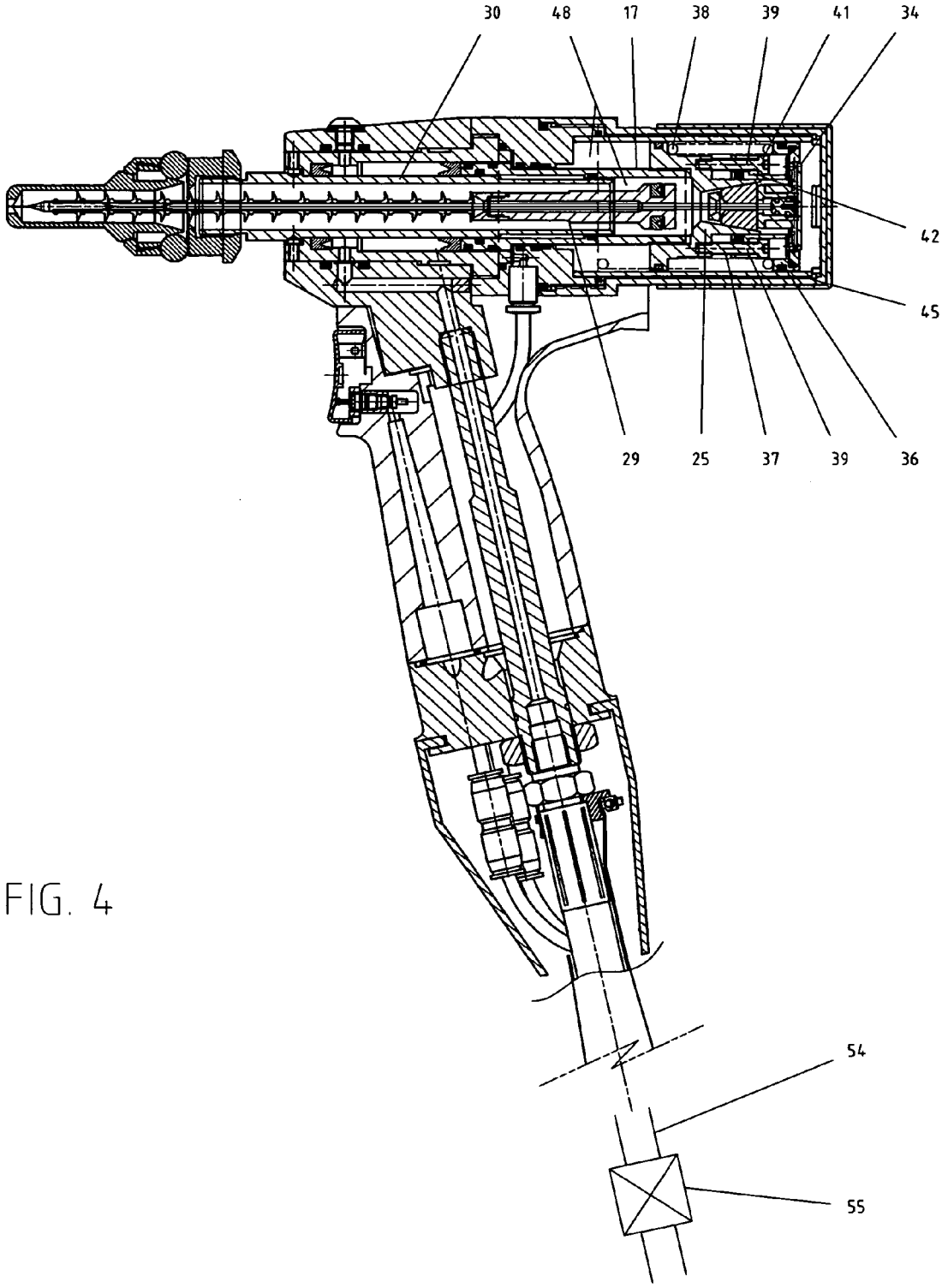
Figure 5:
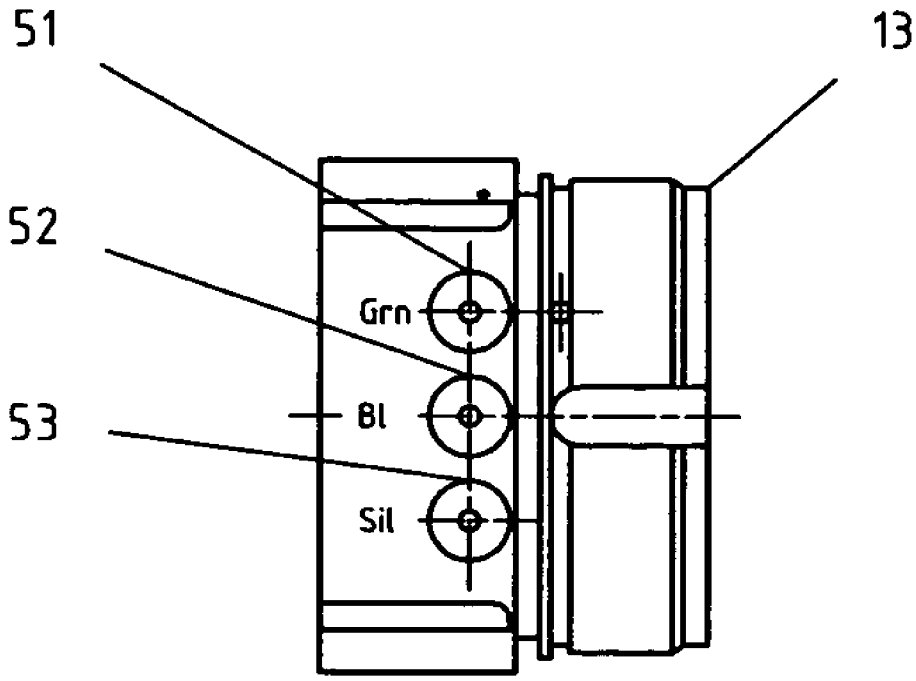

A specific embodiment of the invention will now be described by way of example and with reference to the accompanying drawings, in which:

FIGS. 1 to 4 are sections through a tool, showing respectively successive stages in the operation thereof, and FIG. 5 is a view on the arrow V of FIG. 1.

Figure 2:
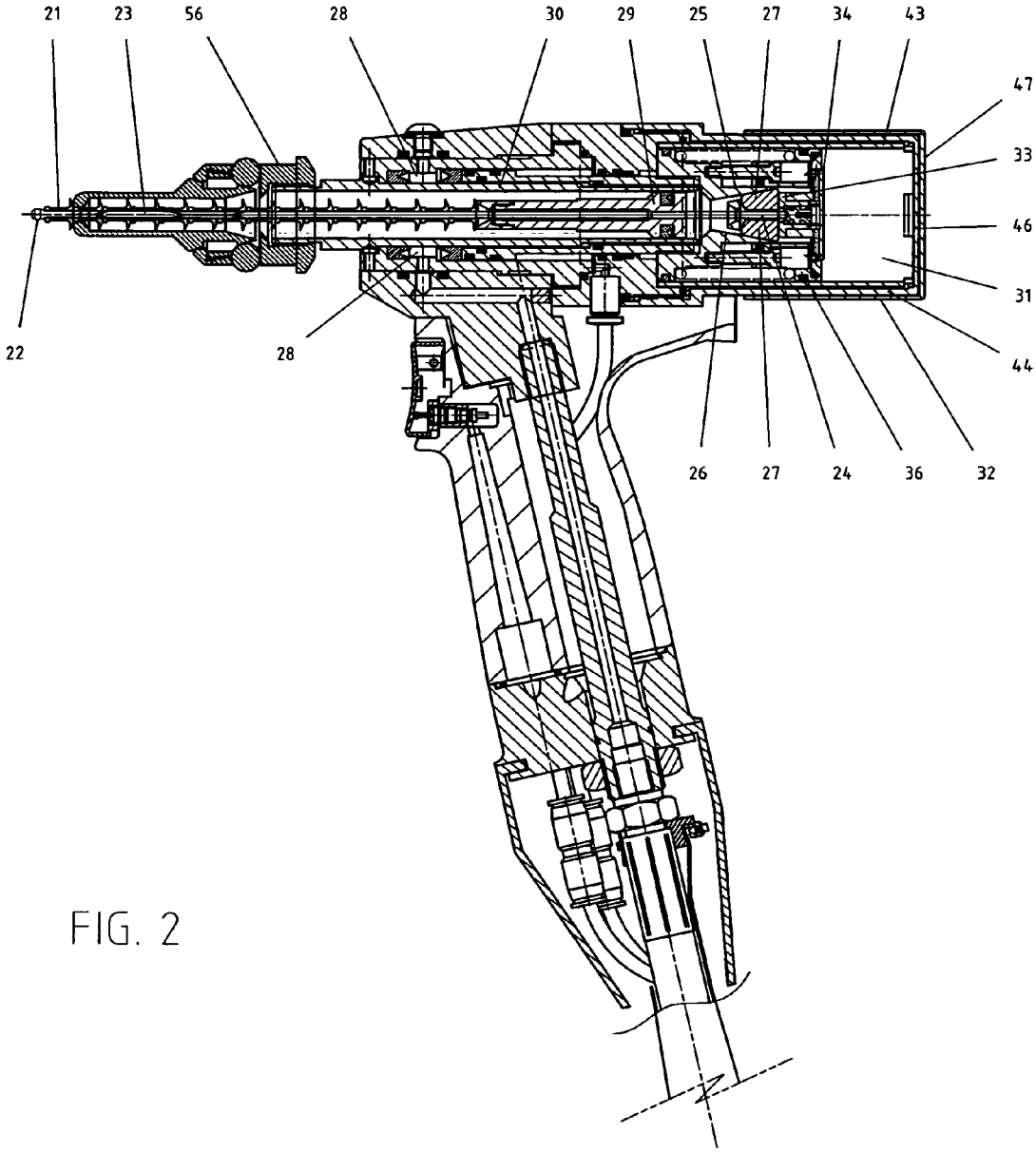

FIG. 1 shows the tool in the rest or non-use position, with the tail jaw cylinder in the forwards position and the tail jaws open to receive a mandrel. In FIG. 2, a mandrel pre-loaded with rivets has been inserted, with the tail end of the mandrel within the jaws but not yet gripped by them. In FIG. 3 the gripping means has been actuated, so that the jaws have been pushed into the jaw holder and are urged radially inwardly to grip the mandrel. In FIG. 4, the tool has been hydraulically actuated and the tail jaw cylinder is in the rearward position, the mandrel being retracted within the tool.

As is usual in tools of this type, the tool consists broadly of a generally cylindrical shaped head 11, secured to a handle 12 which projects below the head. The head includes a main body 13 threadedly but removably secured to a hydraulic cylinder 19. Hydraulic fluid is fed to this, via a hydraulic connector head 14, by a hydraulic feed pipe 15 running through the handle 12, fed by a remote hydraulic intensifier, controlled by a pneumatic remote control operated by a trigger 16 mounted on the handle 12.

This tool is for placing blind tubular rivets of the type well known commercially under the Registered Trade Mark BRIV, by pulling through each rivet in turn the head 22 of an elongated mandrel 23 on which are pre-loaded a plurality of rivets 21, the major part of the mandrel being accomodated within the head 11 of the tool. The mandrel head 22 and the leading rivet 21 protrude beyond a split jaw assembly 56 at the front end of the head 11, the jaws being sprung together to allow a rivet to be fed forwardly through them and then close behind it to support it against the pull of the mandrel head. The placing of such rivets by a tool of this type is well known and understood by industrial users, and need not be described further, The hydraulic retraction means for retracting the mandrel includes a piston 17 sliding within a bore 18 within the hydraulic cylinder 19 which is located within the hydraulic connector 14, its rear end being located within the main body 13.

Gripping means for gripping the tail end part 24 of the mandrel comprises a jaw housing 25 with an internal taper 26, and two mandrel-gripping tail jaws 27 having serrated inner faces which are urged into gripping contact with the mandrel tail by means of the housing taper 26. Such a jaw arrangement is well known in tools of this type.

When the hydraulic retraction means is actuated, hydraulic fluid is fed into the annular space 28 in front of the hydraulic piston 17, thereby to drive it rearwardly, thereby to drive the jaw housing 25 rearwardly, causing the mandrel to be retracted.

Feeding means for feeding new rivets forwardly along the mandrel comprises an air cursor 29, riding on the mandrel 23 and sliding inside a barrel 30. Pneumatic pressure is applied to the rear of the air cursor to feed rivets forwards along the mandrel. Such an arrangement is common in tools of this type.

The gripping means 25, 26, 27 also provides, in the tool of this example, return means for returning the mandrel forwardly after its retraction to place a rivet. In prior tools of this type, the return means has been spring-powered, in the tool of this example the return is pneumatically powered. Pneumatic pressure is applied to the space 31 behind the gripping means, within an end cap assembly 32.

In this tool, the tail jaws 27 are held for axial movement within a jaw piston 33, the rear end of which is secured to a piston plate 34 which slides within the inner concentric sleeve 43 (described below). The piston plate 34 is secured to the rear end of a forwardly projecting sleeve 36. A helical spring 38, held between the piston plate sleeve 36 and the jaw housing 25, urges these two components axially apart. Means for limiting their movement apart is provided by a plurality of screws 39. The forward end of each screw is threadedly engaged with the body of the jaw housing 25, and each screw extends through a suitable aperture in the piston plate sleeve 36, through which the screw heads 41 will not pass. Thus the helical spring 38 urges the two parts of the gripping means relatively apart, this relative movement being limited by the screws 39. Each screw 39 is encased in a spacer sleeve 37, which pre-determines the distance between the screw head 41 and the face of the jaw housing 25. Thus in the tool operation stages illustrated in FIGS. 1 and 2, the piston plate sleeve flange 36 is in contact with the screw heads 41, but in the stages illustrated in FIGS. 3 and 4 there is a gap 42 between each screw head 41 and the piston plate sleeve 36.

As previously mentioned, the piston return means and mandrel gripping means is pneumatically powered, by feeding pneumatic pressure to the space 31 within the end cap assembly 32 and behind the piston plate 34. This pneumatic pressure is routed two concentric cylindrical sleeves, an inner one 43 and an outer one 44 which is part of the end cap assembly 32. There is a cylindrical space 45 between them, and the outer sleeve 44 has an integral end cap 46. To reduce the likelihood of damage to the latter during use of the tool, an outer end cover cap 47 is also provided.

Referring to FIG. 4, it will be apparent that the tool includes a cylindrical space 48 inside the forwards part of the concentric sleeves 43 and 44, and outside the rear end portion of the hydraulic piston 17. This space has a double function. As shown in FIG. 4, when the mandrel gripping means is retracted, the space 48 accomodates the air cursor 29 (the rivet feeding means) and a substantial part of the hydraulic piston 17. When the mandrel gripping means is not retracted (FIGS. 1, 2 and 3), the space 48 accomodates the mandrel gripping means.

As illustrated in FIG. 5, the tool is provided with three pneumatic feed flow channels, 51, 52 and 53. These channels pass through the bottom part of the tool main block 13. The first channel 51 feeds pneumatic power for operating the mandrel gripping and return means, via the aforementioned space 45 into the space 31. The second channel 52 provides for the feeding of additional pneumatic power, when required, to assist in the forwards return of the mandrel. The third channel 53 feeds pneumatic power to the rivet feeding means, i.e. to the rear of the air cursor 29.

As illustrated schematically in FIG. 4, the channel 53 is fed by means of an air hose 54, which is provided with a shut-off valve 55, separate from the tool, for the purpose of shutting off the air feed to the rivet feeding means when not required, to minimize air wastage.

The hydraulic connector 14, together with hydraulic feed pipe 15 and the handle 12, is removable from the tool head 11 (the pneumatic feed hoses to the channels 51, 52 and 53 also being disconnected) if desired. This allows it to be replaced by a connection system having a different external configuration, e.g. one extending parallel to and close to the tool head, so that the lengthy radial projection provided by the tool handle 12 is removed, thus allowing the tool to be inserted into a narrower and deeper hole for use therein.

In the tool of this example, a number of features have enabled reduction in the axial length of the tool head, with respect to known tools of this type. Such features include the return of the mandrel forwardly by pneumatic means instead of a spring (a spring, even when compressed to the practical minimum dimension, occupies a substantially longer length than the distance behind the fully retracted pneumatic piston); the feeding of pneumatic power for this purpose between the two concentric cylindrical parts i.e. the end cap assembly 32 and the inner sleeve 43 (which avoids the need for an external pneumatic feed through the rear wall of the end cap cylinder); the limitation of the movement apart of the two parts of the gripping means under the urging of a spring (this allows a much more compact construction, by eliminating the need for a fixed stop to prevent the rear part of the gripping means from becoming dis-assembled when the pneumatic feed to the gripping and feeding means is shut off); and the provision of a common space which can be occupied, alternatively, either by part of the rivet feeding means, or by part of the mandrel gripping means (thereby eliminating the need for two separate spaces).

The example tool described above has the practical advantage that the overall axial length of the tool head, including the nose assembly 56, is no more than 9.25 inches, which is less than half of the corresponding length on the AVDEL 753 tool, thus enabling its use to place rivets in a workpiece with restricted front clearance.

The invention is not restricted to the details of the foregoing example, but is defined by the accompanying claims.

The invention claimed is:

1. A hydro-pneumatically operated repetition riveting tool, which tool includes:

gripping means for releasably gripping an elongated mandrel at a position remote from the mandrel head, which gripping means comprises a housing with an internal taper, and a plurality of mandrel-gripping jaws which are urged into contact with the mandrel by means of the internal taper;

hydraulic retraction means for retracting the mandrel, thereby to pull the head of the mandrel through a rivet on the mandrel and adjacent the head, thereby to place the rivet;

return means for returning the mandrel forwardly again after placing a rivet;

and rivet feeding means for feeding rivets forwardly towards the mandrel head;

in which the return means is pneumatically powered;

and in which the housing of the gripping means comprises a first part and a second part, spring means for urging the first and second parts relatively apart from each other, and limiting means for limiting the movement apart of the first and second parts under the urging of the spring means.

2. A tool as claimed in claim 1, in which the gripping means also provides the return means.

3. A tool as claimed in claim 2, in which the return and gripping means is pneumatically powered by air which is routed to it between two concentric cylindrical sleeves, one of which has a closed end.

4. A tool as claimed in claim 1, in which the rivet-feeding means comprises a pneumatically operated piston, which tool includes a space which can accommodate, at different stages in the operation of the tool, either a part of the rivet feeding means or a part of the mandrel gripping means.

5. A tool as claimed in claim 4, together with means for independently controlling the feed of pneumatic pressure to the rivet feeding means, whereby air loss through the aforesaid space is minimized.

6. A tool as claimed in claim 1, including means for supplying additional pneumatic pressure to assist in the return of the mandrel forwardly as aforesaid.

7. A tool as claimed in claim 1, which is constructed around a block having running through it the necessary air feed bores or channels.

8. A tool as claimed in claim 1, in which the gripping means also provides the return means, and the rivet-feeding means comprises a pneumatically operated piston, and including means for supplying additional pneumatic pressure to assist in the return of the mandrel forwardly as aforesaid, the tool being constructed around a block, which block contains three bores or channels, the first of which provides means for supplying pneumatic pressure to the gripping and return means, the second of which provides means for supplying pneumatic pressure to the rivet feeding means, and the third of which provides the aforesaid means for supplying the aforesaid additional pneumatic pressure to assist in return of the mandrel.

9. A tool as claimed in claim 1, including hydraulic connection means for connecting hydraulic power to the hydraulic retraction means, which connection means is interchangeable with other connection means of a different external configuration, thereby to provide the optimum configuration for handling and operation of the tool.

* * * * *